United States Patent [19]

Roehn

[11] 4,127,977

[45] Dec. 5, 1978

[54] CARTON HANDLING AND ERECTING MACHINE

[75] Inventor: Herbert F. Roehn, Prospect Heights, Ill.

[73] Assignee: SMW Packaging Corporation, Prospect Heights, Ill.

[21] Appl. No.: 840,720

[22] Filed: Oct. 11, 1977

[51] Int. Cl.[2] ..... B65B 43/32

[52] U.S. Cl. ..... 53/565; 93/53 R

[58] Field of Search ..... 53/186; 93/53 R

[56] References Cited

U.S. PATENT DOCUMENTS

| | | | |
|---|---|---|---|
| 3,053,153 | 9/1962 | Gilbert | 93/53 R |
| 3,161,113 | 12/1964 | Walter et al. | 93/53 R |

*Primary Examiner*—Travis S. McGehee

*Attorney, Agent, or Firm*—Allegretti, Newitt, Witcoff & McAndrews

[57] ABSTRACT

An improved machine for handling and erecting initially folded cartons includes axial ways and an intermittently actuable, axially reciprocating advancing-erecting mechanism. Pivotally mounted along a drive shaft of the advancing-erecting mechanism are advancing fingers and carton pick-up catches that extend upward between the ways. Mounted ahead of a carton erecting station are stationary flap separating fingers that direct a flap of the cartons between a clamp and a clamping plate of an intermittently actuable clamping mechanism. Mounted above the carton erecting station is an intermittently actuable final erecting mechanism for erecting cartons from a partially erect condition to a fully erect condition. Cartons are sequentially moved to the carton erecting station by the catches on a forward stroke of the drive shaft and clamped. The cartons are then erected to a partially erect condition by the advancing fingers on a return stroke of the drive shaft, erected to the fully erect condition, and moved from the carton erecting station by the advancing fingers on the next forward stroke of the drive shaft.

14 Claims, 11 Drawing Figures

CARTON HANDLING AND ERECTING MACHINE

BACKGROUND OF THE INVENTION

The present invention relates to a carton handling machine, and more particularly, to an improved machine for erecting initially folded cartons.

In the past, a variety of packaging machines have been designed, including those disclosed in U.S. Pat. No. 3,107,013 titled "Method and Means For Stacking Articles"; No. 3,134,309 titled "Apparatus for Erecting Packing Cases"; No. 3,236,027 titled "Packaging Machine"; No. 3,299,611 titled "Packaging Machine"; No. 3,323,283 titled "Apparatus for Handling Cases Being Loaded"; No. 3,343,335 titled "Apparatus for Setting-up and Filling Cartons"; No. 3,584,434 titled "Carton Handling and Loading Method and Apparatus Machine"; and No. 3,954,165 titled "Automatic Collating Machine".

In these patents, a number of mechanisms for handling and erecting folded cartons are disclosed. U.S. Pat. No. 3,134,309 discloses a mechanism which includes rotatable suction cups which lift the trailing top wall of a carton as it passes by. In U.S. Pat. No. 3,299,611, a mechanism is disclosed wherein pneumatically actuated, vertically directed "pre-break fingers" raise a carton slightly, and conveyor fingers complete the erection. U.S. Pat. Nos. 3,323,283 and 3,343,335 disclose more mechanisms which include suction cups; in U.S. Pat. No. 3,323,283, the suction cups are both above and below the passing cartons, while in U.S. Pat. No. 3,343,335, the suction cups pull cartons down to a conveyor belt from an overhead bin. Finally, a pneumatically actuated, vertically directed plunger is disclosed in U.S. Pat. No. 3,584,434, which extends through an opening in the lower wall of a folded carton to push the upper walls upward.

While the mechanisms disclosed in the identified patents have been useful in the past, each has certain limitations and disadvantages. For example, the mechanism of U.S. Pat. No. 3,584,434 is useful with only cartons having holes through which the plunger may extend. Further, U.S. Pat. Nos. 3,134,309, 3,323,283 and 3,299,611 all involve suction cups, and thus may be limited to use with cartons of a material to which suction cups can effectively attach. Also, a substantial amount of energy is expended in supplying a vacuum to suction cups. The purpose of the present invention is to overcome these and other disadvantages and limitations of prior devices.

SUMMARY OF THE INVENTION

In a principal aspect, the present invention is an improved machine for handling and erecting cartons. The cartons have walls and flaps, and the walls are joined along first intervening fold lines. Pairs of the flaps are joined to the walls at opposed ends thereof along second intervening fold lines, and the cartons are folded to an initially flat condition about the first and second intervening fold lines.

The improved machine includes a frame defining a path for movement of the cartons with a carton erecting station therealong. Mounted on the frame is an intermittently actuable carton pick-up means that individually moves cartons in the initially flat condition along the path of movement to the carton erecting station. As cartons move toward the carton erecting station, at least one of the flaps is separated from the remainder by separator means. The separator means is mounted on the frame adjacent the carton erecting station. The separated flap is clamped at the carton erecting station by clamping means, to substantially prevent linear and rotational movement thereof.

Synchronized with the carton pick-up means and the clamping means are an intermittently actuable advancing-erecting means and an intermittently actuable erecting means. The advancing-erecting means operates on a forward stroke to move the cartons along the path of movement from the carton erecting station and operates on a return stroke to erect cartons to a partially erect condition. The erecting means erects cartons from the partially erect condition to a fully erect condition.

Cartons that are moved to the carton erecting station are sequentially clamped by the clamping mechanism, erected to the partially erect condition by the advancing-erecting mechanism, erected to the fully erect condition by the erecting mechanism and then advanced by the advancing-erecting mechanism.

It is thus a principal object of the present invention to provide an improved packaging machine for erecting cartons that are initially folded.

Another object is to provide improved carton erecting and handling apparatus that may be used independently or incorporated into a packaging machine that erects, loads and seals cartons.

Another object is to provide intermittently actuable apparatus for advancing and erecting cartons that operates on a forward stroke to advance the cartons and operates on a return stroke to erect the cartons to a partially erect position.

Another object is to provide apparatus for separating the flaps of the cartons and clamping at least one of the flaps to secure the cartons against shifting and dislocation while they are being erected and loaded.

Another object is to provide an improved packaging machine which may be readily adapted to handle and erect cartons of varying configurations, including those having slick surface finishes and unpunctuated walls.

Another object is to provide a packaging machine that has a minimum number of independently moving mechanisms, thereby simplifying the synchronization of those mechanisms.

Another object is to provide a packaging machine that operates at high speed for rapid erection and handling of cartons.

Another object is to provide a packaging machine that is compact in size.

Another object is to provide a packaging machine that generates reduced noise while in operation.

A further object is to provide a packaging machine that is reliable and readily repairable.

A still further object is to provide a machine which consumes a minimum amount of energy in its operation.

These and other objects and advantages of the present invention will become apparent from the description of the preferred embodiment of the invention, which follows.

BRIEF DESCRIPTION OF THE DRAWINGS

The preferred embodiment of the invention will be described in connection with the drawing wherein.

In the following description of the preferred embodiment, the word "forward" indicates a direction from right to left in FIG. 1. It should be understood that this convention is used solely as an aid to illustration of the preferred embodiment of FIG. 1.

DESCRIPTION OF THE PREFERRED EMBODIMENT

Figure 1:
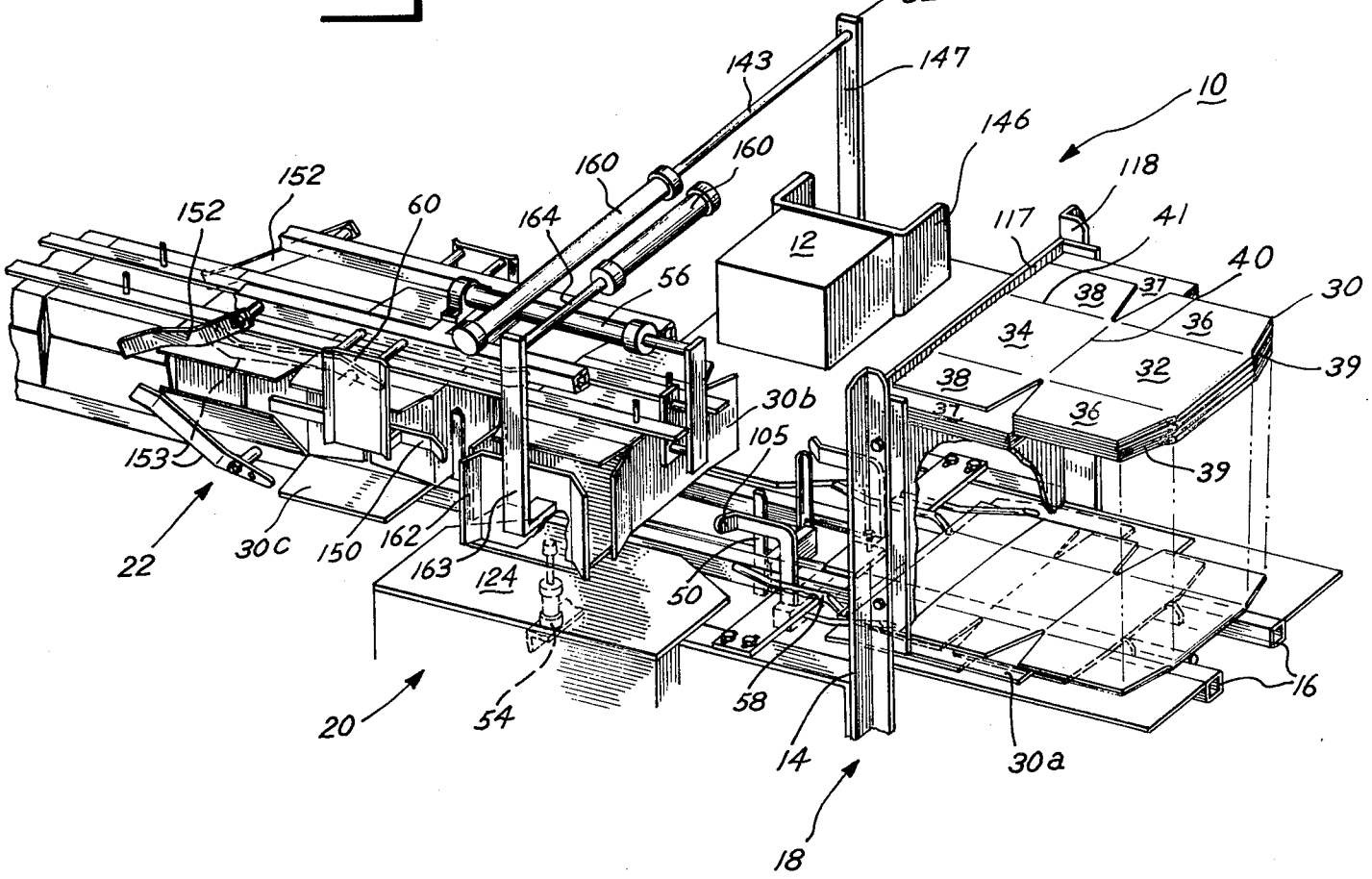
FIG. 1 is a perspective view of a preferred embodiment of the present invention.

Referring to FIG. 1, the preferred embodiment of the present invention is a packaging machine 10 for packaging articles 12 into cartons 30. The packaging machine 10 includes an elongated frame 14 which supports a pair of parallel, axially-directed ways 16, along which a path of travel is defined for the cartons 30. Spaced along the ways 16 are a carton storage station 18, a carton erecting-loading station 20, and a flap folding station 22.

The packaging machine 10 includes four synchronized reciprocating mechanisms, namely an axially reciprocating advancing-erecting-folding mechanism referred to as advancing mechanism 50, a transversely reciprocating loading mechanism 52, a vertically reciprocating clamping mechanism 54, and an axially reciprocating final erecting mechanism 56. The packaging machine 10 also includes a set of stationary flap separating fingers 58 and a set of stationary flap folding plows 60.

Figure 3:
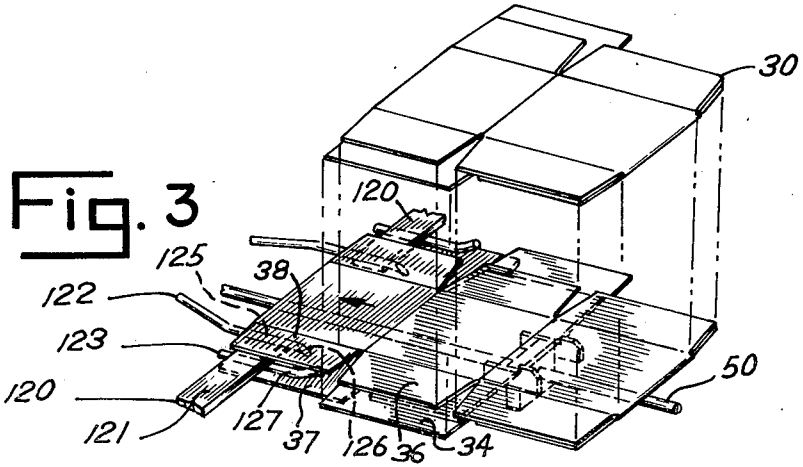
FIG. 3 is a partial perspective view of the separator fingers of the machine shown in FIG. 1.

In one cycle of operation of the packaging machine 10, each mechanism 50–56 reciprocates once. Beginning a cycle, the advancing mechanism 50 travels forward, moving a single carton 30*a* from the carton storage station 18 toward the carton erecting-loading station 20, as shown in FIG. 3. On the same forward stroke, the advancing mechanism 50 moves the carton 30*b*, that was erected and loaded on the previous cycle, from the erecting-loading station 20 to the flap folding station 22. There the flap folding plows 60 fold the flaps of the carton 30*b* inward. The advancing mechanism 50 also moves forward the carton 30*c* that was previously positioned at the flap folding station 22.

Figure 5:
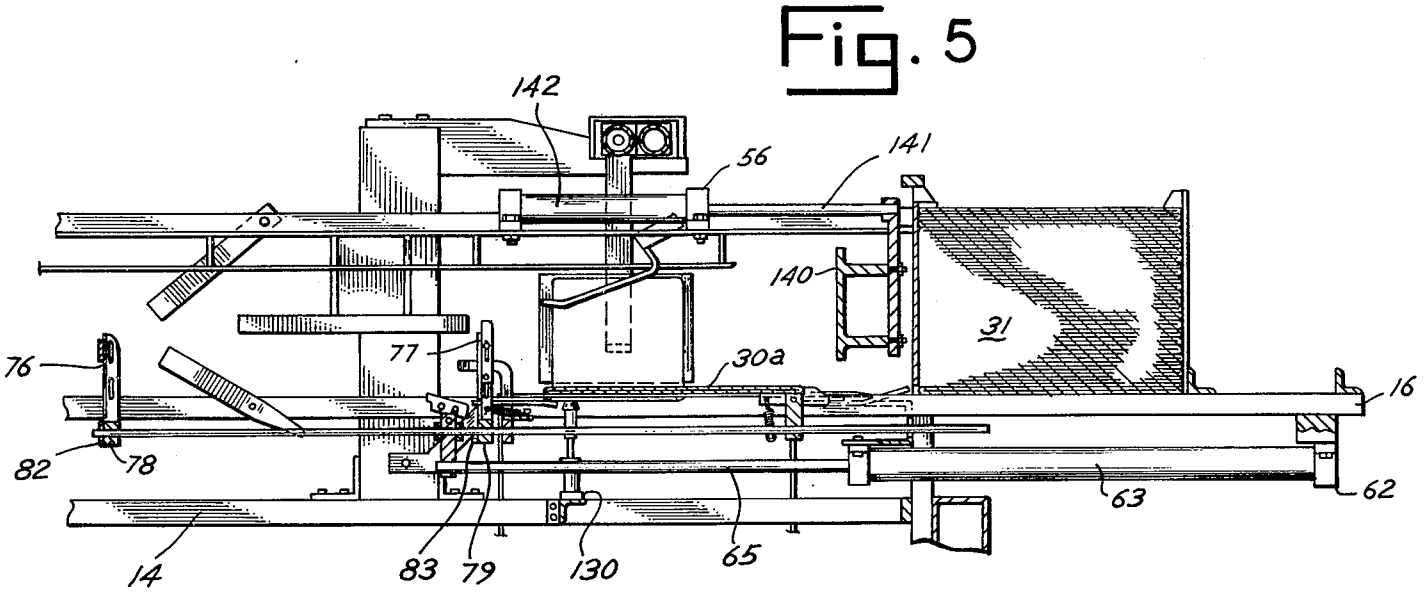
FIG. 5 is a cross-sectional side view taken along the vertical center line of the machine shown in FIG. 1.

As the carton 30*a* moves toward the erecting-loading station 20, the flap separating fingers 58 separate the flaps of the carton 30*a*, as shown in FIG. 3, so that the bottom flap of the carton 30*a* can be clamped, as shown in FIG. 5. When the advancing mechanism 50 reaches the full extent of its forward stroke, the carton 30*a* is positioned at the carton erecting-loading station 20. The clamping mechanism 54 then actuates to secure the bottom of the carton 30*a* against shifting or dislocation.

Figure 8:
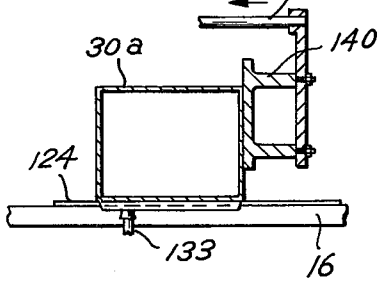
FIG. 8 is a partial cross-sectional side view similar to FIGS. 6 and 7 wherein the erector lever has erected a carton to a fully erect position.
Figure 7:
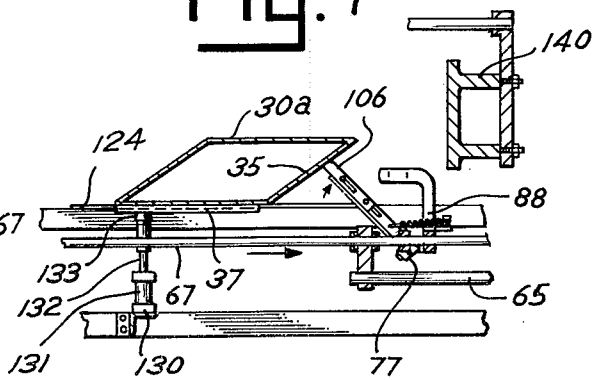
FIG. 7 is a partial cross-sectional view similar to FIG. 6 in which the advancing fingers of the machine have erected a carton to a partially erect position.

On its return stroke, the advancing mechanism 50 erects the clamped carton 30*a* to a partially erect condition, as shown in FIG. 7. The final erecting mechanism 56 then pushes the partially erect carton 30*b* to a fully erect condition, as shown in FIG. 8. The loading mechanism 52 loads the articles 12 into the carton 30*a*, the clamping mechanism 54 releases, and the packaging machine 10 begins a new cycle.

As an aid to further illustration of the packaging machine 10, the cartons 30 each include cardboard walls 32–35 and pairs 36–39 of flaps, as shown in FIG. 1. The walls 32–35 respectively define the top, bottom, leading and trailing sides of the cartons 30, and are referred to as the top wall 32, the bottom wall 33, the leading wall 34 and the trailing wall 35. The walls 32–35 are mutually joined along first intervening fold lines 40 and the cartons 30 are oriented upon the ways 16 so that the first intervening fold lines 40 are transverse to the axis of the ways 16.

The flaps 36–39 define the end panels of the cartons 30 when the cartons 30 are erected and flaps 36–39 are folded. The flaps 36–39 are respectively joined to the ends of the walls 32–35 along second intervening fold lines 41 and are referred to as the top flap 36, the bottom flap 37, the leading flap 38 and the trailing flap 39. The cartons 30 are initially folded about the first intervening fold lines 40 and the second intervening fold lines 41 to a flat condition. In this condition, the top wall 32 and the trailing wall 35 overlie the leading wall 34 and the bottom wall 33, and the flaps 36,39 overlie the flaps 38,37.

Figure 2:
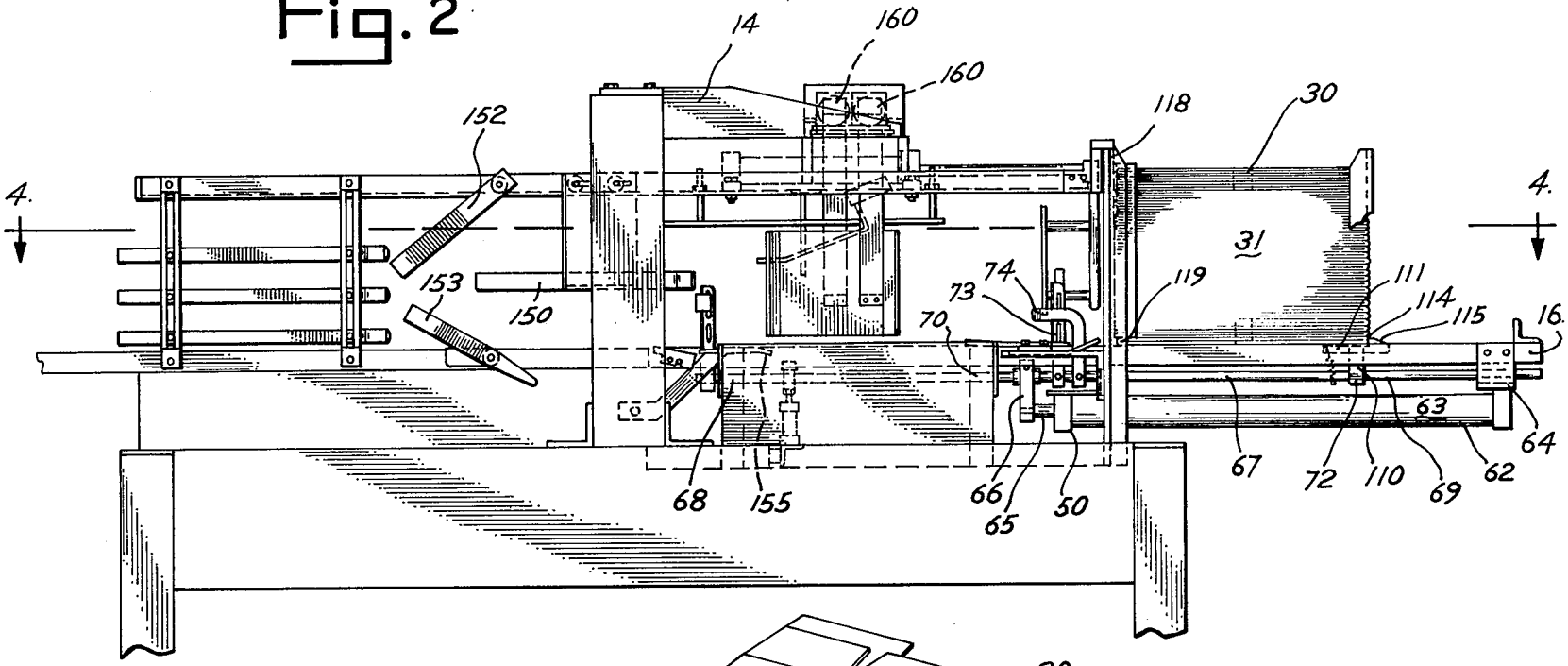
FIG. 2 is a side elevation of the machine shown in FIG. 1.

Referring now to FIG. 2, the carton advancing mechanism 50 includes a pneumatic linear actuator, referred to as the advancing actuator 62. The cylinder 63 of the advancing actuator 62 is secured to the frame 14 under the ways 16 by mounting brackets such as the mounting bracket 64. The advancing actuator 62 has a rod 65 axially aligned with the ways 16. The rod 65 may be moved linearly forward from the retracted position shown in FIG. 2 to the extended position shown in FIG. 5, in response to pressurization of the cylinder 63.

Attached to the rod 65 by a tie bracket 66 is a non-rotating, axially movable drive shaft 67 which is axially aligned with and underlying the ways 16. At its forward end 68, a first advancing finger assembly 71 is attached to the drive shaft 67, and at the rearward end 69 a carton pick-up assembly 72 is attached to the drive shaft 67. Near the midpoint at 70, a second advancing finger assembly 73 and a flap folding finger assembly 74 are attached to the drive shaft 67.

When the rod 65 is in the retracted position shown in FIG. 2, the first advancing finger assembly 71 is rearward of the flap folding station 22. The second advancing finger assembly 73 and the flap folding finger assembly 74 are rearward of the carton erecting-loading station 20, and the carton pick-up assembly 72 is rearward of the carton storage station 18. When the rod 65 is in the fully extended position, the first advancing finger assembly 71 is forward of the flap folding station 22, the carton pick-up assembly 72 is at the carton erecting-loading station 20, and the second advancing finger assembly 73 and the flap folding finger assembly 74 are at the flap folding station 22. Thus, the cartons 30 are advanced on the ways 16 from the carton storage station 18 to the carton erecting-loading station 70 by the carton pick-up assembly 72; from the carton erecting-loading station 20 to the flap folding station 22 by the second advancing finger assembly 73; and from the flap folding station 22 forward by the first advancing finger assembly 71.

Figure 9:
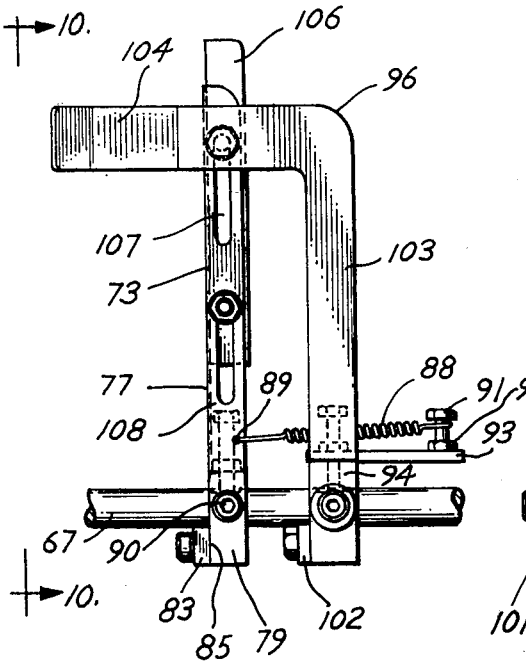
FIG. 9 is a side elevation of the advancing fingers and the flap folding fingers of the machine.
Figure 10:
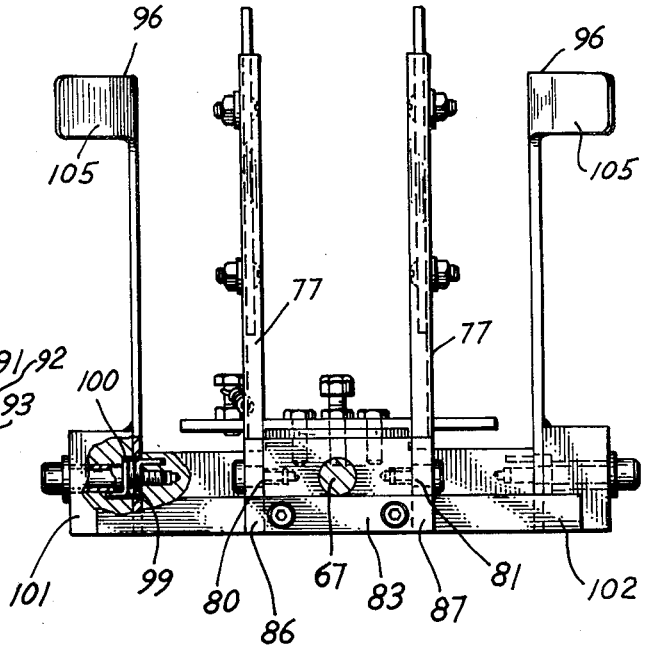
FIG. 10 is a front elevation of the advancing and flap folding fingers taken along line 10—10 in FIG. 9.
Figure 11:
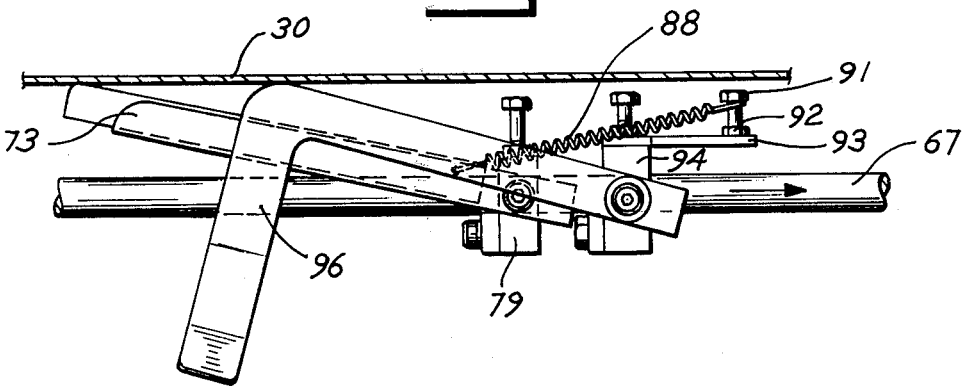
FIG. 11 is a side elevation similar to FIG. 10 in which the flap folding fingers and the advancing fingers are pivoted to pass under a carton.

As shown in FIGS. 5, 9 and 10, the first advancing finger assembly 71 and the second advancing finger assembly 73 include elongated advancing fingers 76,77. These advancing fingers 76,77 are pivotally mounted to transversely opposed ends 80,81 of crosspieces 78,79, respectively. The crosspieces 78,79 are secured to the drive shaft 67. The advancing fingers 76,77 extend upward between the ways 16, and are spring biased to the erect position. A stop plate 82,83 secured to the forward face 84,85 of each crosspiece 78,79 extends transversely outward to provide stop surfaces 86,87 against which the advancing fingers 76,77 are biased.

As shown in FIG. 9, the advancing fingers 77 of the second advancing finger assembly 73 are spring biased by a coil spring 88 which is hooked at one end through a hole 89 to one of the advancing fingers 77 above the pivot point 90. The coil spring 88 is hooked at its other end about a bolt 91 which is threaded into a nut 92 welded to a horizontal plate 93. The tension in the coil spring 88 may be adjusted by threading the bolt 91 up or down in the nut 92.

The plate 93 is bolted to the top face 94 of a crosspiece 94 which is a part of the flap folding finger assembly 74. The crosspiece 94 is secured to the drive shaft 67 behind the crosspiece 79. Two flap folding fingers 96 are pivotally mounted to the transversely opposed faces 97,98 of the crosspiece 95. As shown in FIG. 10, the flap folding fingers 96 are spring biased by torsion springs 99, as are the advancing fingers 76 of the first advancing finger assembly 71. Each torsion spring 99 is fitted into a recess 100 defined in a sleeve 101, which is welded to each flap folding finger 96. As in the advancing finger assemblies 71,73, a stop plate 102 is attached to the crosspiece 95.

The flap folding fingers 96, as shown in FIG. 9, are L-shaped, and formed of sheet metal. Each flap folding finger 96 includes a lower, upright section 103 and an upper or horizontal section 104. As best shown in FIG. 1, the horizontal section 104 has a plow portion 105 which is skewed outward so as to contact the trailing flap 39 of each carton 30 and fold it to the folded position.

Figure 6:
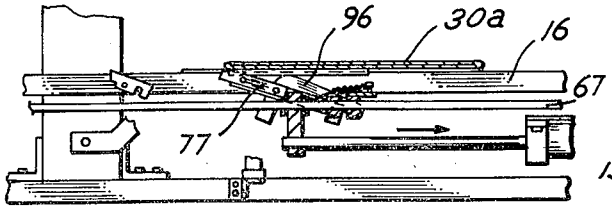
FIG. 6 is a partial cross-sectional side view of an apparatus for advancing and erecting the cartons.

The advancing fingers 76,77 and the flap folding fingers 96 are pivotally mounted, as described above, so that on the return stroke of the advancing actuator 62 the fingers 76,77,96 rotate forward and under any cartons 30 which are on the ways 16, as shown in FIG. 6. Further, the fingers 76,77,96 are spring biased, as described, to return to their erect positions after they pass under the cartons 30.

As shown in FIG. 7, the length of the advancing fingers 77 and the tension of the spring 88 are selected so that as the advancing fingers 77 pass under a folded carton 30, the advancing fingers 77 lift the trailing wall 35 of the carton 30*a* and erect that carton to a partially erect position. As stated, the tension in the spring 88 is adjusted by moving the bolt 91, and the spring 88 may be easily replaced by stronger or weaker springs, as needed. Because the advancing fingers 77 include finger extensions 106, which are bolted through slots 107 to the fingers weldments 108, the length of the advancing fingers 77 is also adjustable. The length of the advancing fingers 77 and the tension of spring 88 should be selected so that the advancing fingers 77 press against wall 35 with a torque sufficient to erect the cartons 30.

Referring again to FIG. 2, the carton pick-up assembly 72 includes a crosspiece 110 secured to the drive shaft 67 and two catches or dogs 111 pivotally mounted to the transversely opposed ends of the crosspiece 110. Each catch 111 has a forward facing shoulder 114 and an upwardly facing cam surface 115 behind the shoulder 114.

Springs 116 bias the catches 111 to a position in which the shoulders 114 extend above the level of the ways 16. The height of each shoulder is approximately the same as the height of a single carton 30, as initially folded, and thus on the forward stroke of the advancing actuator 62, the catches 111 engage the bottom carton 30a of the stack 31 and push the bottom carton 30 forward. All the cartons 30 in the stack 31 except the bottom carton 30a are kept from advancing by the transverse plate 117, shown in FIG. 1. The plate 117 is mounted between the front hopper supports 118, and it extends downward to within the height of a single folded carton 30. The ways 16 and the plate 117 thus define a gap 119 above the ways 16 through which only the bottom carton 30a may pass.

As the cartons 30 are advanced from the carton storage station 18 to the carton erecting-loading station 20, as stated above, they pass across the stationary flap separating fingers 58. The bottom flaps 37 are separated from the other flaps 36,38,39 so that the clamping mechanism 54 may clamp the bottoms of the cartons 30 as they arrive at the carton erecting-loading station 20.

Referring to FIG. 3, the flap separating fingers 58 include two separating finger assemblies 120 which are bolted to the frame 14 substantially in the plane of the ways 16 and on transversely opposite sides thereof. Each separating finger assembly 120 includes a bracket 121, a first or inner separating finger 122 welded to the top of the bracket 121, and a second or outer separating finger 123 welded to the bottom of the bracket 121. Both the first separating finger 122 and the second separating finger 123 are elongated, formed from metal rod stock, and each is oriented axially so as to be generally parallel to the ways 16.

Figure 4:
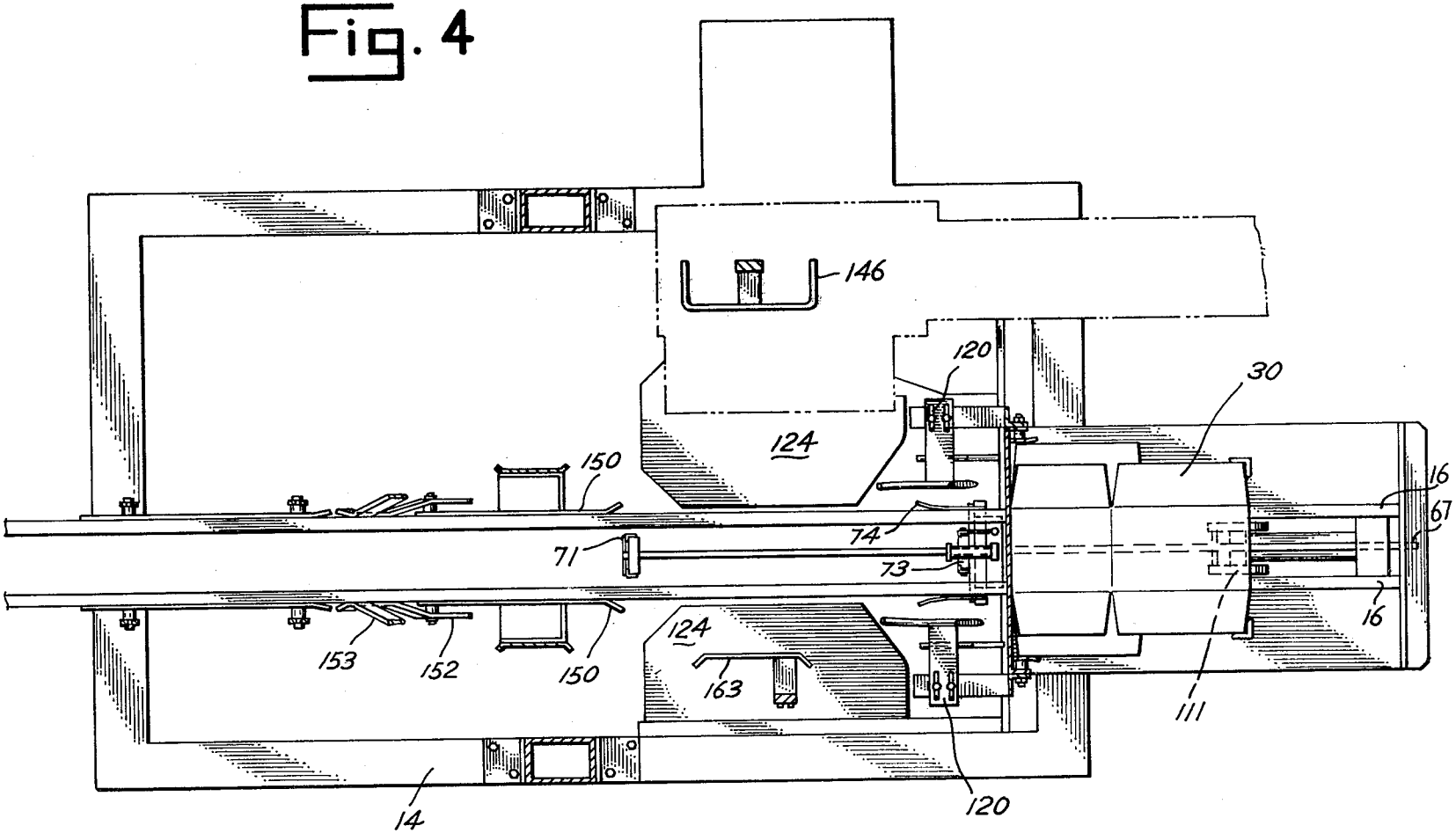
FIG. 4 is a cross-sectional view of the machine of FIG. 1 taken along line 4—4 of FIG. 2.

The first separator fingers 122 are constructed and located to direct the leading flap 38, the top flap 36 and the trailing flap 39, which are short, upward over clamping plates 124, shown in FIG. 4, and the second separator fingers 123 are constructed to direct the longer bottom flaps 37 under the clamping plates 124. The first separating finger 122 has an end 125, that tapers in thickness to a narrow point 126. In the position in which the fingers 122 are attached to the frame 14, the point 126 faces the carton storage station 18 and is slightly below the level of the ways 16. The second separator finger 123 has an end 127, which faces the carton storage station 18, that is closer to the carton storage station 18 than the point 126 and is above the level of the ways 16. The end 127 slants downward toward the carton erecting-loading station 20. The first separator finger 122 is at a transverse distance from the ways 16 that matches the transverse distance of the flaps 38,36,39, and the second separator finger 123 is at a transverse distance just greater than that of the flaps 38,36,39. The bottom flaps 37 of the cartons 30 thus contact the second separator fingers 123 and are directed downward by the end 127 and the other flaps 38,36,39 are directed upward by the end 125.

The clamping mechanism 54, mentioned above, and best shown in FIG. 7, includes two pneumatic linear actuators, referred to as clamp actuators 130, located below the clamping plates 124 at the carton erecting-loading station 20. The cylinders 131 of the clamping actuators 130 are mounted to the frame 14 and the rods 132 thereof are vertically actuable from the retracted position shown in FIG. 2 to the fully extended position shown in FIG. 7. In the fully extended position, the rubber tip 133 on the end of the rod 132 presses the bottom flap 37 against the underside of the clamping plate 124. The carton 30 at the carton erecting-loading station 20 is thus kept from being dislocated by the lifting action of the advancing fingers 77.

The final erecting mechanism 56, referred to in FIGS. 1, 5 and 8 includes a squaring lever 140 which depends from the rod 141 of an axially aligned pneumatic linear actuator, referred to as erecting actuator 142. The erecting actuator 142 is mounted to the frame 14 above the ways 16, out of the path of travel of the cartons 30. The rod 141 of the erecting actuator 142 is operable between the positions shown in FIGS. 1 and 8. As shown in FIG. 7, the cartons 30 which have been erected to the partially erect position are in the axial path of travel of the squaring lever 140. Thus on retraction of the rod 141, the squaring lever 140 erects cartons 30 to the fully erect position.

Once erected, the cartons 30 are loaded by the loading mechanism 52. The articles 12 are pushed transversely into an open end of the cartons 30 by a reciprocating pusher 146. A reciprocating back stop 162 simultaneously moves inward to the opposite open end of the carton 30 to insure that the articles 12 are properly located in the carton 30. As shown in FIG. 1, the pusher 145 and the back stop 162 are attached respectively to depending arms 147,163. The arms 147, 163 are respectively attached to the rods 143,164 of two oppositely actuating transversely aligned pneumatic linear actuators, referred to as loading actuators 160. As shown in FIG. 2, the loading actuators 160 are mounted to the frame 14 overhead of the carton erecting-loading station 20.

Finally, as shown in FIG. 1, the set of flap folding plows 60 located at the flap folding station 22 includes two side plows 150 which are attached to the frame 14 in alignment with the path of travel of the leading flaps 38 of the cartons 30. As the cartons 30 pass the side plows 150, the leading flaps 38 are folded in and the trailing flaps 37 are held in as folded by the flap folding fingers 96. The top flaps 36 are then folded down by upper plows 152 and the bottom flaps 37 are folded up by the bottom plows 153 to complete the end panel of the cartons. A bottom flap guide 155 at the forward edge of the carton erecting-loading station 20, under the clamping plates 124 and adjacent the clamping mechanisms 54, insures that the bottom flaps 37 are in position for the bottom plows 153.

The four mechanisms 50,52,54,56 of the packaging machine 10 are synchronized by a timing apparatus, which, as well-known, includes a set of valves (not shown) connecting the actuators 62,130,142,160, to a compressed air supply (not shown), and a set of mechanical or electromechanical triggers (not shown) for opening and closing the valves. A first trigger and valve responsive to the movement of the drive shaft 67 pressurize the clamp actuators 130 to extend the rods 132 when the rod 65 of the advancing actuator 62 reaches its extended position, and a second such trigger and valve pressurize the erector actuator 142 on the return stroke of the advancing actuator 62 as the cartons 30 at the carton erecting-loading station 20 approach the partially erect condition. A third trigger and valve responsive to retraction of the erector actuator 142 then pressurize the loading actuators 160 and a fourth trigger and valve responsive to retraction of the loading actuators 160 pressurize the advancing actuator 62 to extend the rod 65.

From the foregoing, it should be apparent to those having skill in the art that additions, modifications and changes could be made in the design of the carton handling and erecting machine described herein. For example, the packaging machine 10 could be constructed as described in the description of the preferred embodiment or the loading mechanism 52, the flap folding plows 60 and the flap folding station 22 could be eliminated in a machine which only erects cartons 30. Thus the scope of the invention claimed should be measured by the following claims, rather than the preceding description. All additions, modifications and changes which come within the meaning and range of equivalency of the claims are intended to be embraced therein.

I claim:

1. An improved machine for handling and erecting cartons, said cartons having walls and flaps, said walls being joined along first intervening fold lines and pairs of flaps being joined to said walls at opposed ends thereof along second intervening fold lines, said cartons being folded to an initially flat condition about said first and second intervening fold lines, said improved machine comprising, in combination:

a frame defining a path for movement of said cartons with a carton erecting station therealong;

intermittently actuable carton pick-up means for individually moving said cartons in said initially flat condition along said path of movement to said carton erecting station, said carton pick-up means mounted on said frame;

separator means for separating at least one of said flaps, said separator means being mounted on said frame adjacent said carton erecting station;

intermittently actuable clamping means for clamping said separated flap to substantially prevent linear and rotational movement thereof, said clamping means mounted on said frame at said carton erecting station;

intermittently actuable advancing-erecting means (i) operating on a forward stroke for moving said cartons along said path of movement from said carton-erecting station, and (ii) operating on a return stroke thereof for erecting said cartons to a partially erect condition, said advancing-erecting means mounted on said frame; and intermittently actuable erecting means for erecting said cartons from said partially erect condition to a fully erect condition, said erecting means mounted on said frame.

2. An improved machine for handling and erecting cartons, said cartons having walls and flaps, said walls being joined along first intervening fold lines and pairs of said flaps being joined to said walls at opposed ends thereof along second intervening fold lines, said carton being folded to an initially flat condition about said first and second intervening fold lines, said improved machine comprising, in combination:

a frame having ways defining an axis and an axial path for movement of said cartons with a carton erecting station therealong;

an intermittently actuable and axially reciprocating carton advancing-erecting mechanism mounted on said frame, said carton advancing-erecting mechanism reciprocating through a forward stroke and a return stroke and including, carton pick-up means operable on said forward stroke for individually moving said cartons in said initially flat condition along said path of movement to said carton erecting station, and carton advancing-erecting means (i) operating on said forward stroke for moving said cartons along said path of movement from said carton erecting station, and (ii) operating on said return stroke for erecting said cartons from said initially flat condition to a partially erect condition;

flap separating means for separating at least one of said flaps as said cartons are moved to said carton erecting station, said flap separating means mounted on said frame adjacent said carton erecting station;

intermittently actuable clamping means for clamping the separated flap at said carton erecting station to substantially prevent linear and rotational movement of one of said walls, said clamping means mounted on said frame at said carton erecting station; and intermittently actuable erecting means for erecting said cartons from said partially erect condition to a fully erect condition, said erecting means mounted on said frame at said carton erecting station.

3. The improved machine of claim 2 further comprising means mounted on said frame for synchronizing said carton advancing-erecting mechanism, said clamping means and said erecting means so that said cartons are sequentially moved to said carton erecting station, clamped, erected to a fully erect position, unclamped, and moved from said carton erecting station.

4. The improved machine of claim 2 wherein said carton advancing-erecting means includes elongated finger members.

5. The improved machine of claim 2 wherein said carton advancing-erecting mechanism includes a drive shaft movably mounted on said frame, said carton pick-up means and said carton advancing-erecting means being mounted on said drive shaft.

6. The improved machine of claim 5 wherein said carton advancing-erecting means includes elongated finger members, said finger members being rotatably mounted to said drive shaft and rotating under said cartons on said return stroke.

7. The improved machine of claim 6 wherein said carton advancing-erecting means further includes spring means attached to said finger members and secured to said drive shaft for biasing said finger members to an upright position.

8. The improved machine of claim 5 wherein said carton advancing-erecting mechanism includes a pneumatic linear actuator with a cylinder and rod, said cylinder attached to said frame and said rod secured to said drive shaft.

9. The improved machine of claim 2 wherein said flap separating means includes stationary flap separating fingers mounted on said frame in the path of movement of said flaps, one of said flap separating fingers directing one of said flaps downward and another of said flap separating fingers directing other of said flaps upward.

10. The improved machine of claim 2 wherein said clamping means includes a clamping plate attached to said frame at said carton erecting station and an intermittently actuable clamp mounted on said frame under said clamping plate for clamping said flap against said clamping plate.

11. The improved machine of claim 10 wherein said clamping means includes a pneumatic linear actuator attached to said frame for actuating said clamp.

12. A packaging machine for packaging articles into cartons said cartons having walls and flaps, said walls being joined along first intervening fold lines and pairs of said flaps being joined to opposed ends of said walls along second intervening fold lines, said cartons being folded about said first and second intervening fold lines to an initially flat condition, said improved machine comprising, in combination:

a frame having ways defining an axis and an axial path for movement of said cartons with stations therealong, said stations including a carton storage station, a carton erecting-loading station forward of said storage station, and a flap folding station forward of said carton erecting-loading station;

an intermittently actuable and axially reciprocating carton advancing-erecting mechanism mounted on said frame, said mechanism reciprocating through a forward stroke and a return stroke, said mechanism including carton pick-up means operable on said forward stroke for individually moving said cartons in said initially flat condition along said path of movement from said carton storage station to said carton erecting-loading station, carton advancing means operating on said forward stroke for advancing cartons forward from said flap folding station, carton advancing-erecting means (i) operating on said forward stroke for moving said cartons from said carton erecting station to said flap folding station, and (ii) operating on said return stroke for erecting said cartons to a partially erect condition;

flap separating means for separating at least one of said flaps as said cartons are moved to said carton erecting-loading station, said flap separating means attached to said frame between said carton storage station and said carton erecting-loading station in the path of movement of said flaps;

intermittently actuable clamping means for clamping the separated flap of cartons stationed at the carton erecting-loading station to substantially prevent linear and rotational movement of one of said walls, said clamping means attached to said frame at said carton erecting-loading station;

intermittently actuable final carton erecting means for erecting said cartons stationed at said carton erecting-loading station from said partially erect condition to a fully erect condition, said loading means attached to said frame at said carton erecting-loading station;

intermittently actuable loading means for loading said articles into said cartons in said fully erect position at said carton erecting-loading station, said loading means attached to said frame at said carton erecting-loading station; and flap folding plows attached to said frame at said flap folding station for folding the flaps of said cartons.

13. In a machine for handling and erecting cartons, said cartons having walls and flaps, said walls being joined along first intervening fold lines and said flaps being joined to said walls along second intervening fold lines, said cartons being folded about said first and second intervening fold lines to an initially flat condition, said machine including a frame having a path for movement of said cartons with stations therealong, one of said stations being a carton erecting station, said machine further including a first mechanism attached to said frame for moving said cartons along said path of travel to said carton erecting station and a second mechanism attached to said frame for erecting said cartons from a partially erect condition to a fully erect condition, the improvement comprising, in combination:

an intermittently actuable carton advancing-erecting mechanism mounted on said frame, said mechanism including a drive shaft movable axially through a forward stroke and a return stroke, at least one advancing finger member pivotally mounted to said drive shaft, a spring attached to said advancing finger member and secured to said drive shaft, and a stop plate secured to said drive shaft, said spring biasing said member to an upright position against said stop plate, said advancing finger member thereby pushing said cartons forward from said carton erecting-loading station on said forward stroke of said drive shaft, and on said return stroke, said advancing finger member pivoting under said cartons and erecting said cartons from said folded condition to said partially erect position.

14. In a machine for handling and erecting cartons, said cartons having walls and flaps, said walls being joined along first intervening fold lines and said flaps being joined to said walls along second intervening fold lines, said carton being folded about said first and second intervening fold lines to an initially flat condition, said machine including a frame having a path for movement of said cartons with stations therealong, one of said stations being a carton erecting station, said machine further including a first mechanism on said frame for moving said cartons along said path of travel to said carton erecting station and a second mechanism on said frame for erecting said cartons from said initially flat condition to a fully erect condition, the improvement comprising, in combination:

clamping means for clamping at least one of said flaps at said carton erecting station for substantially preventing linear and rotational movement of one of said walls, said clamping means including at least one clamping plate and at least one pneumatically actuated clamp for pinning said flap against said clamping plate; and flap separating means for separating one of said flaps and directing said separated flap between said clamping plate and said clamp, said flap separating means including at least two flap separating fingers attached to said frame adjacent said clamping plate in the path of movement of said flaps, one of said flap separating fingers directing one of said flaps between said clamping plate and said clamp and the other of said flap separating fingers directing the remainder of said flaps across said clamping plate away from said clamp.

* * * * *